US005392672A

United States Patent [19]

Larson et al.

[11] Patent Number: 5,392,672

[45] Date of Patent: Feb. 28, 1995

[54] RATCHET WRENCH

[75] Inventors: Larry R. Larson, 581 Helena Cir., Littleton, Colo. 80124; Carl E. Campbell, Morrison, Colo.

[73] Assignee: Larry R. Larson, Littleton, Colo.

[21] Appl. No.: 28,656

[22] Filed: Mar. 9, 1993

[51] Int. Cl.[6] ..... B25B 13/46

[52] U.S. Cl. ..... 81/60; 81/58.4

[58] Field of Search ..... 81/58.4, 60, 61

[56] References Cited

U.S. PATENT DOCUMENTS

| | | | |
|---|---|---|---|
| 1,350,315 | 8/1920 | Katzmarek | 81/60 |
| 1,769,070 | 7/1930 | Nowosielski | 81/60 |
| 3,533,315 | 10/1970 | Maeda | 81/60 |

FOREIGN PATENT DOCUMENTS

| | | | |
|---|---|---|---|
| 81460 | 10/1954 | Denmark | 81/60 |
| 395251 | 10/1908 | France | 81/60 |
| 2227095 | 11/1974 | France | 81/60 |
| 3003601 | 8/1981 | Germany | 81/60 |

*Primary Examiner*—James G. Smith
*Attorney, Agent, or Firm*—Timothy J. Martin

[57] ABSTRACT

A ratchet wrench imparts rotational movement to a relatively large workpiece such as the stem of a water main valve or a fire hydrant. The wrench includes an annular driver member, a housing having an elongated recess, a pawl element and a bias element. The annular driver member is adapted to detachably engage the workpiece and includes a plurality of driver teeth disposed circumferentially around its outer periphery. The housing receives the annular driver member so that rotational movement can be imparted to it within the housing and the handle structure extends from the housing to provide mechanical advantage for imparting the rotational movement. The elongated recess extends into the housing along a longitudinal access. The elongated recess is positioned with respect to an imaginary line tangent to a selected radius of the annular driver member such that the longitudinal axis is disposed substantially parallel to or coextensive with the selected radius. The pawl element is slideably disposed within the elongated recess and configured to sequentially register with the driver teeth as the annular driver member relatively rotates within the housing. The bias element resiliently urges the pawl element into contact with the annular driver member.

18 Claims, 4 Drawing Sheets

RATCHET WRENCH

FIELD OF THE INVENTION

The present invention relates to wrenches, and, more particularly, the present invention relates to ratchet wrenches. Specifically, the present invention concerns ratchet wrenches adapted for heavy duty applications, such as turning large nuts and bolts of industrial machinery as well as operating valves of municipal water mains, fire hydrants or the like.

BACKGROUND OF THE INVENTION

Since the industrial revolution, simple wrenches have been used to fasten and unfasten bolts and screws to and from machinery and other structures. Various types of wrenches exist today, and two common types of these wrenches are open-ended wrenches and box-ended wrenches. The open-ended wrench comprises a handle having a forked portion attached to one or both ends of the handle. The box-ended wrench comprises a handle having a rigid annulus attached to one or both ends of the handle. In either instance, a set of wrenches having varying sizes of forked-ends or boxed-ends is provided to match the various sizes of bolt heads or screw heads that require fastening or unfastening. Using even a simple wrench is sometimes cumbersome and time consuming. For example, an operator of a simple wrench might turn the handle of the wrench circumferentially over and over again about the bolt head until it is sufficiently unfastened so that the operator can remove the remaining portion of the bolt from the structure by hand. When the operator has limited space within which to turn his wrench, another procedure must be employed to remove the bolt. Here, the operator must engage the bolt with the wrench, preferably, at an optimum leverage point. Once engaged, the wrench is moved angularly about the bolt head until it is no longer practical. The wrench is detached from the bolt and engaged once again, preferably, at the optimum leverage point so that the wrench could again be moved angularly about the bolt head. This process must be repeated over and over again until the bolt is sufficiently removed from the structure so that the remaining portion of the bolt could be removed by hand.

To overcome these problems with simple open-ended and box-ended wrenches, the commonly known ratchet wrench was developed. With a ratchet wrench, the operator is able to fasten or remove a bolt or screw from a structure without turning the handle of the wrench an entire rotation around the head and without detaching the wrench from the head. Thus, speed and efficiency in fastening or removing a bolt or screw are achieved. However, typical ratcheting mechanisms incorporated into standard ratchet wrenches are relatively delicate structures. As a result, ratchet wrenches are usually limited in use to smaller, lighter-duty applications. A need exists in industry to provide a reliable, rugged ratchet wrench that is simple and efficient to use for heavy-duty applications. Such a ratchet wrench could be employed to open and close large valves such as those used for water mains or fire hydrants or fasten and remove large nuts and bolts to and from heavy-duty industrial equipment such as those used in mining or steel-making industries.

Large valves are used in many applications. In the oil and gas industry for example, large valves are placed throughout a pipeline system so that the flow of oil or gas can be controlled. Municipal water districts also place large valves throughout its water distribution pipeline so that the flow of water can be controlled and distributed to its customers. To avoid indiscriminate tampering with the opening or closing of city water mains, typically, the water main valve is provided without a handle. As a result, municipal water department crews, excavators and contractors are required to carry their own wrenches. Generally, these wrenches are of the type having either an open end or a box end that is adapted to receive the stem of the valve. A contractor might use a pipe wrench to open or close the valve of the city water main. In some municipalities, using a pipe wrench is undesirable because the toothed jaws of a pipe wrench often damage the valve stem. Excess damage of the valve stem may render it useless resulting in costly replacement.

Firemen also use either open ended or box ended wrenches to open and close the ports as well as the valves of fire hydrants. Upon arrival at a fire scene, it is desirable to open the ports and the valve of the fire hydrant as quickly as possible so that the firemen could begin extinguishing the blaze to minimize fire damage. Using an open ended or box ended wrench, although very reliable, is quite time consuming. Although employing a ratchet wrench to operate a fire hydrant would be desirable from a time-savings standpoint, such a ratchet wrench used in any emergency situation must be reliable.

It is with these considerations as well as others that the present invention evolved.

OBJECTS OF THE PRESENT INVENTION

It is an object of the present invention to provide a new and useful ratchet wrench that can be used to more efficiently open and close large valves.

It is yet another object of the present is to provide such a ratchet wrench which can more rapidly and reliably open and close large valves.

It is yet a further object of the present invention to provide such a ratchet wrench that is durable so it can withstand large torsional forces necessary to open and close large valves in heavy-duty applications.

A still further object of the present invention is to provide such a ratchet wrench that has a limited number of mechanical parts and is therefore cost effective to manufacture.

Yet another object of the present invention is to provide such a ratchet wrench which is simple to manufacture and maintain.

Yet another object of the present invention is to provide a ratchet wrench that is so rugged and reliable it can be used in emergency situations such as opening valves of fire hydrants.

SUMMARY OF THE INVENTION

Generally, the ratchet wrench of the present invention is adapted to impart rotational movement to a relatively large workpiece such as the stem of a water main valve or a fire hydrant or large nuts and bolts typically found on large industrial machinery. The ratchet wrench broadly includes a handle that supports a ratchet wrench head that includes an annular driver member, a housing having an elongated recess, a pawl element and a bias element. The annular driver member which is adapted to detachably engage the workpiece includes a plurality of driver teeth disposed circumferentially around its outer periphery. The housing is adapted to receive the annular driver member so that rotational movement can be imparted to it within the housing, and the handle structure extends from the housing to provide mechanical advantage for imparting the rotational movement. The elongated recess extends into the housing along a longitudinal axis. The elongated recess is positioned with respect to an imaginary line tangent to a selected radius of the annular driver member such that the longitudinal axis is disposed substantially parallel to or coextensive with the selected radius. The pawl element is slideably disposed within the elongated recess and configured to sequentially register with the driver teeth as the annular driver member relatively rotates within the housing. The bias element resiliently urges the pawl element into contact with the annular driver member.

When the annular driver member is detachably engaged with the workpiece and the handle structure moves angularly about the workpiece in a first direction, sequential ones of the driver teeth are operative to exert a radial force component against the pawl element. When this occurs, the pawl element is longitudinally displaced into the elongated recess to enable relative rotation between the handle structure and the annular driver member as the sequential ones of the driver teeth move past the pawl element. When the handle structure moves angularly about the workpiece in a second direction opposite the first direction, engaged ones of the driver teeth exert a compression force component against the pawl element perpendicularly with respect to the selected radius of the annular driver member. When this occurs, relative rotation between the handle structure and the annular driver member is prohibited so that now rotational movement can be imparted to the workpiece.

The elongated recess preferably includes a first sidewall and a second sidewall disposed opposite and parallel to the first sidewall. Either the first sidewall of the recess can be co-planar with the selected radius of the annular driver member or the second sidewall of the recess can be co-planar with the selected radius of the annular driver member.

The pawl element includes a first contact surface and a second contact surface disposed at an acute angle with respect to the first contact surface to form a shoulder portion which projects radially inwardly with respect to the annular driver member. The shoulder portion is configured to matably engage the driver teeth of the annular driver member. The pawl element may include a plurality of shoulder portions which are also configured to matably engage the driver teeth of the annular driver member. When the handle moves angularly about the workpiece in the second direction opposite the first direction, engaging ones of the driver teeth may exert a retention force component against each the pawl element radially inwardly of the annular driver member. This retention force component further urges the pawl element into sequential registration with the annular driver member.

The annular driver member can be configured to have an aperture extending coaxially through the annular driver member. This aperture is shaped to receive the workpiece and can be shaped as a polygon. Alternatively, the annular driver member can include a pair of stub shafts. Each stub shafts is rigidly attached to the annular driver member and projects coaxially outwardly therefrom on opposite sides. The stub shafts are configured to operably receive a second type of workpiece.

The ratchet wrench of the present invention may include a pair of elongated recesses extending into the housing. Each of these recesses would have a longitudinal axis and is positioned relative to a respective imaginary tangent line of a selected diameter of the annular driver member. The longitudinal axis of each of the elongated recesses would be disposed substantially parallel or coextensive with the selected diameter. Each of the elongated recesses would have flat first sidewall co-planar with the selected diameter of the annular driver member and a flat second sidewall disposed parallel to the first sidewall whereby the first sidewalls of the pair of elongated recesses would be co-planar with each other. It would follow then that a pair of pawl elements and a pair of bias elements would be required for this exemplary embodiment of the present invention.

In any event, the ratchet wrench may be structured to have a single ratchet head or a pair of ratchet heads. Where a single ratchet head is employed, a single handle may be provided. Alternatively, a pair of oppositely projecting handles may be provided; here, the ratchet head is located centrally of the ratchet wrench. where two ratchet heads are employed, the handle interconnects the two heads which are locate at opposite ends of the handle.

These and other objects of the present invention will become more readily appreciated and understood from a consideration of the following detailed description of the preferred embodiment when taken together with the accompanying drawings, in which:

EXEMPLARY EMBODIMENTS OF THE PRESENT INVENTION

Several exemplary embodiments of the present invention are hereinafter described. As the description of each embodiment proceeds, one of ordinary skill in the art will appreciate the simplicity and ruggedness of each exemplary embodiment. An important feature inherent to the simplicity and ruggedness of the embodiments is performance reliability, particularly for heavy duty applications such as, for example, the turning of valves on fire hydrants. When a fireman removes the ports from a fire hydrant and opens its valve, it is imperative that his/her ratchet wrench operates for its intended purpose of imparting rotational movement to the ports and the stem of the valve of the fire hydrant.

Figure 1:
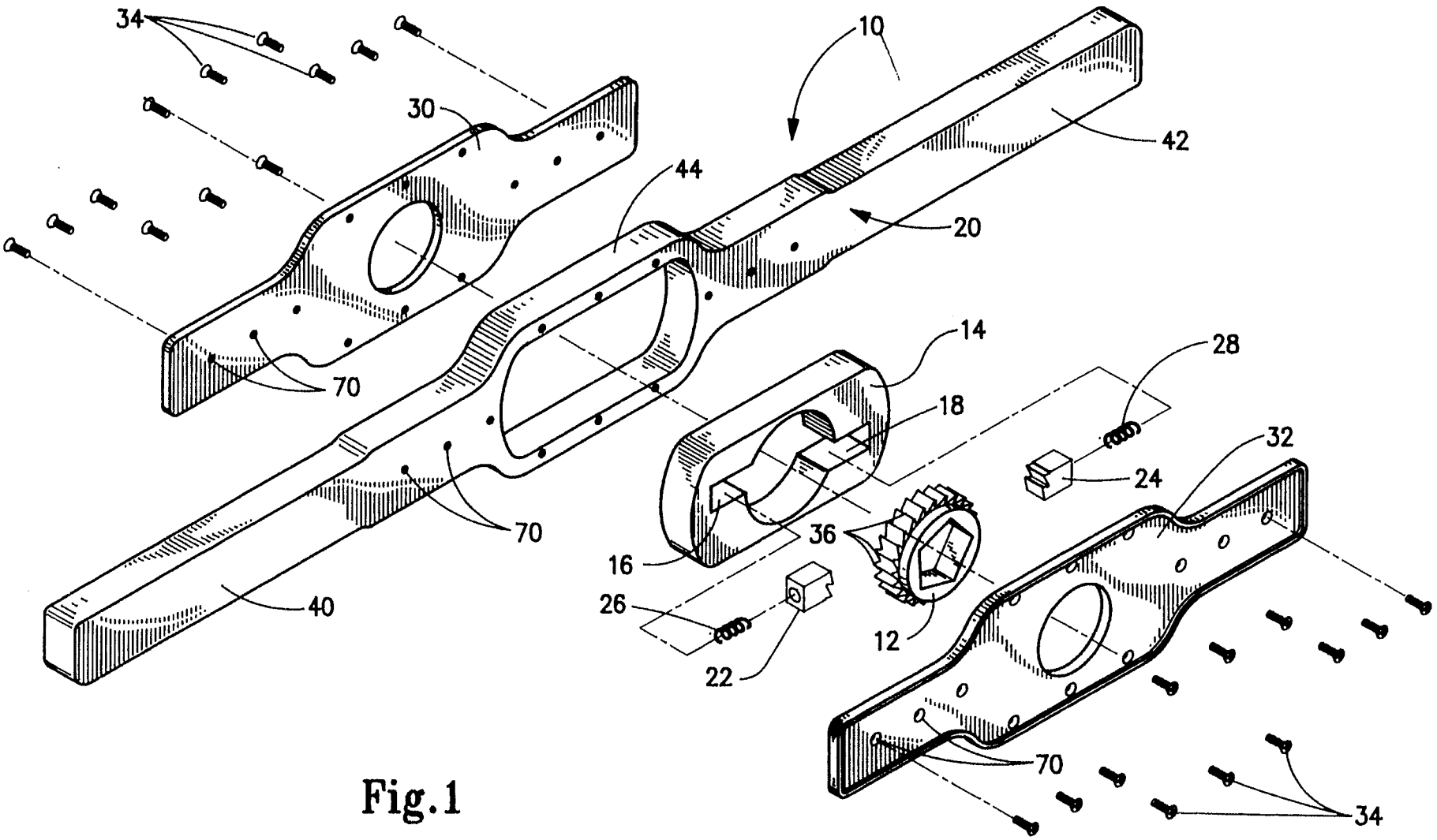
FIG. 1 is ,an exploded perspective view of a ratchet wrench according to an exemplary embodiment of the present invention.

As is generally shown in FIG. 1, a ratchet wrench 10 of the first exemplary embodiment of the present invention includes an annular driver member 12, a housing 14 having a pair of elongated recesses 16, 18 formed therein, a handle 20, a pair of pawl elements 22, 24 and a pair of bias elements 26, 28. The ratchet wrench 10 also includes a first cover plate 30 and a second cover plate 32 which are secured to the handle 20 by a plurality of non-compressive bolt sets 34. Thus, ratchet wrench 10 has a ratchet head formed by housing 14 and the elements supported therein.

The annular driver member 12 includes a plurality of driver teeth 36 which are disposed circumferentially around an outer periphery of the annular driver member 12. The annular driver member 12 for the first exemplary embodiment of the present invention is formed with an aperture 38 that extends coaxially through the annular driver member 12. This particular aperture 38 is configured as a pentagon in order to receive a workpiece such as a stem of a valve for fire hydrants and water mains. The aperture of course could be configured as any polygon so that it can receive a specified workpiece such as a nut or a head of a bolt. The annular driver member 12 is made from metal such as stainless steel or some other rigid material.

Figure 2:
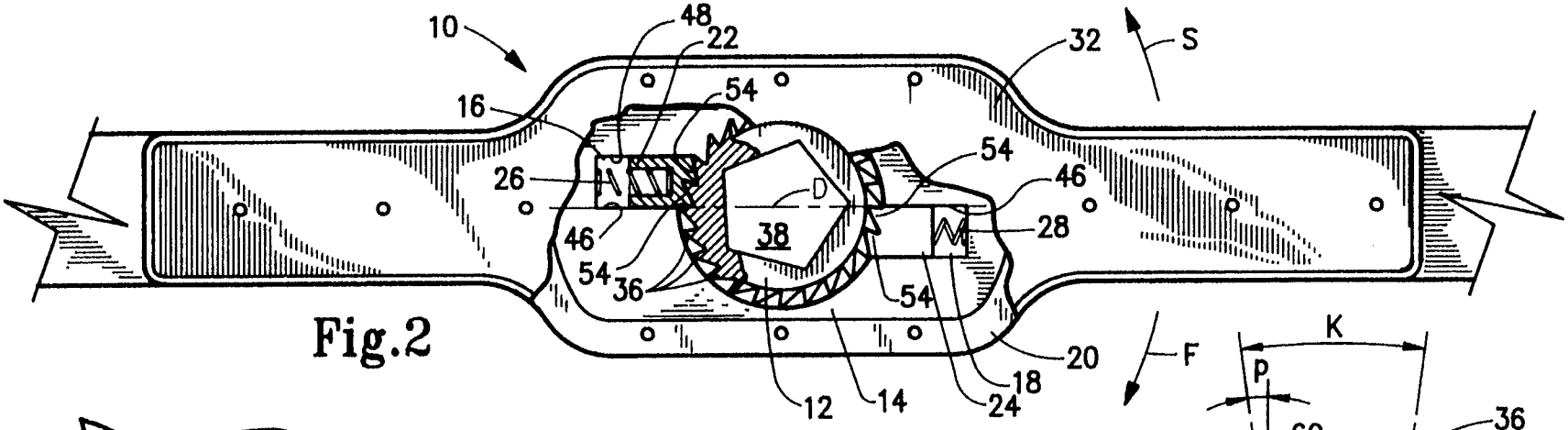
FIG. 2 is a top plan view, partially broken-away and partially in cross-section, of an assembled ratchet wrench such as that ratchet wrench shown in FIG. 1.

The housing 14, which is made from a metal such as nickel plated tooled steel or some other rigid material, is adapted to receive annular driver member 12 so that rotational movement of the annular driver member 12 can occur within the housing 14, which is best shown in FIG. 2. The handle 20 is secured to and extends from the housing 14. For the first exemplary embodiment of the present invention, the handle 20 includes a first handle portion 40, a second handle portion 42 and a casing portion 44. The first handle portion 40 and the second handle portion 42 are rigidly attached to the casing portion 44 such that the first handle portion 40 extends from the casing portion 44 in a direction opposite to but aligned with the second handle portion 42. As best shown in FIG. 2, the housing 14 is received by the casing portion 44 in a close-fitting relationship such that when the handle structure moves angularly about the workpiece, the housing 14 moves along with it. The handle 20 can be fabricated from metal or some other suitable material such as high density polyethylene. It is preferable that an aluminum alloy be selected because of its rigidity as well as its resistance to corrosion.

Shown in FIG. 2, each of the elongated recesses 16, 18, extend into the housing 14. Pawl elements 22, 24 are slideably engaged within respective recesses 16, 18, and are configured to sequentially register with the driver teeth 36 of the annular driver member 12. The bias elements 26, 28, employed for the first exemplary embodiment of the present invention, are metal coil springs; however, rubber or some other resilient material may be used in lieu of springs. Each bias element 26, 28 is disposed within the respective recesses 18, 20 so that they may resiliently urge each of the pawl elements 22, 24 into contact with the annular driver member 12.

Figure 3:
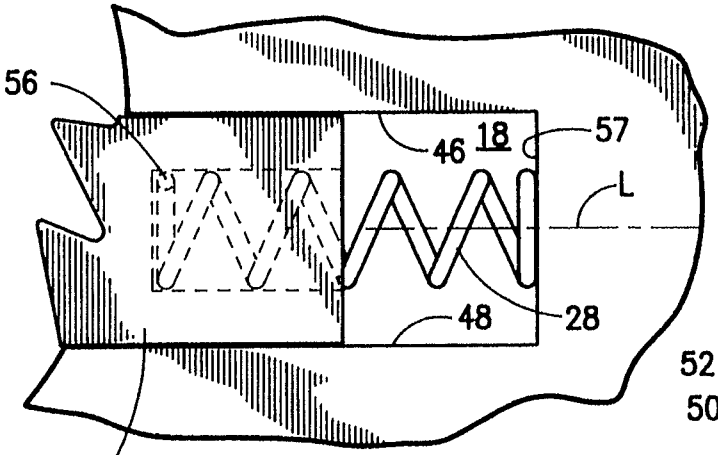
FIG. 3 is an enlarged view showing a pawl element slideably disposed within a recess of a housing of the ratchet wrench shown in FIG. 2.

FIG. 3 illustrates the relationship between pawl element 24 and the elongated recess 18. This illustration is used as an example only. One of ordinary skill in the art would comprehend that the same relationship exists between the pawl element 22 and the elongated recess 16. With reference directed again to FIG. 3, the elongated recess 18 has a flat first sidewall 46 and a flat second sidewall 48 which is disposed parallel to the flat first sidewall 46. The pawl element 24 is dimensioned for slideable engagement between the flat first sidewall 46 and the flat second sidewall 48. The recess 20 has a longitudinal axis "L". This longitudinal axis "L" may be located anywhere within recess 20 provided that the longitudinal axis "L" is between and parallel to the flat first and second sidewalls 46, 48. It would follow then that the recess 18 also has a longitudinal axis "L" and it may be located anywhere therewithin provided that it is between and parallel to the flat first and second sidewalls 46, 48.

Figure 4:
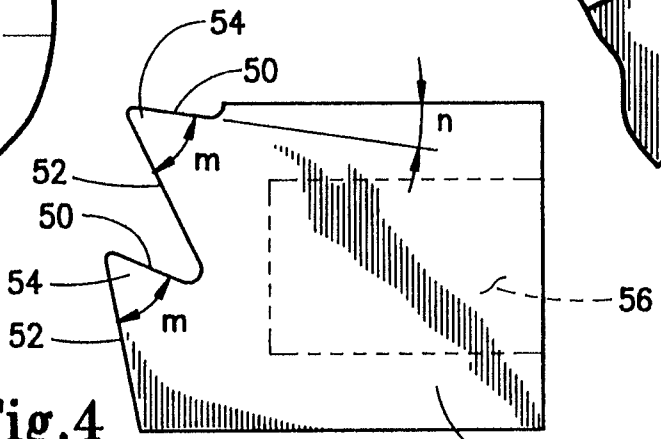
FIG. 4 is an enlarged top plan view of the pawl element shown in FIG. 3.

A representative pawl element 24 is shown in FIG. 4, and it should be understood that pawl element 22 is structured similarly to pawl element 24. Here, pawl element 24 includes a first pawl working surface 50 and a second pawl working surface 52 which is disposed at an acute angle "m" with respect to the first contact surface 50 to form a shoulder portion 54. It may be noted that the first pawl working surface 50 is formed slightly off-set at an angle "n" from the surface of the pawl element 24 which is in slideable engagement with the flat first sidewall 46 as shown in FIG. 3. Preferably, angle "n" is equal to about 5° although it may range between 0° and 10°. Further, pawl element 24 includes a bore 56. As best shown in FIG. 3, the bore 56 is configured to receive an end portion of the bias element 28. The opposite end portion of the bias element 28 rests against a rear wall 57 of the elongated recess 18 to urge the pawl element 24 radially inwardly with respect to the annular driver member 12. With reference to FIG. 2, the shoulder portion 54 projects radially inwardly relative to the annular driver member 12 and is configured to matably engage the driver teeth 36 of the annular driver member 12. The pawl element 24 for purposes of the description of the first exemplary embodiment includes a plurality of shoulder portions 54.

Figure 5:
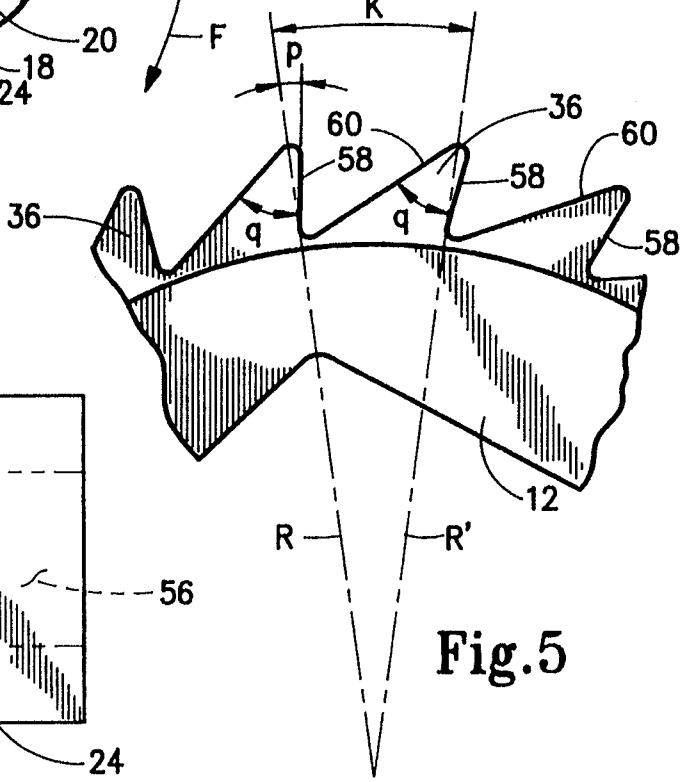
FIG. 5 is a partial enlarged view of the annular driver member showing the configuration of the driver teeth.

The driver teeth 36 of the annular driver member 12 are shown in greater detail in FIG. 5. With reference to imaginary radii "R" and "R'" of the annular driver member 12, each driver tooth 36 is angularly and sequentially displaced from one another at an angle "k". Preferably, angle "k" is equal to approximately 15°. Also, each driver tooth 36 is formed with a compression working surface 58 formed at an angle "p" greater than the imaginary radius "R". Angle "n" relating to the first pawl working surface 50 of pawl element 22, 24 (FIG.

4) and angle "p" relating to the compression working surface 58 of the driver teeth 56 (FIG. 5) are substantially equal so that the respective surfaces can be in substantial contact when the should portions 54 are matably engaged with the driver teeth 36 of the annular driver member 12. The compression working surface 58 of each driver tooth 36 forms an angle "q" with a driver working surface 60. Acute angle "m" relating to the pawl element 22, 24 (FIG. 4) and angle "q" relating to the driver teeth 36 (FIG. 5) are substantially equal so that the shoulder portions 54 of the pawl elements 22, 24 can be matably engaged in sequential registration with the driver teeth 36 of the annular driver member 12 as shown in FIG. 2.

Figure 6:
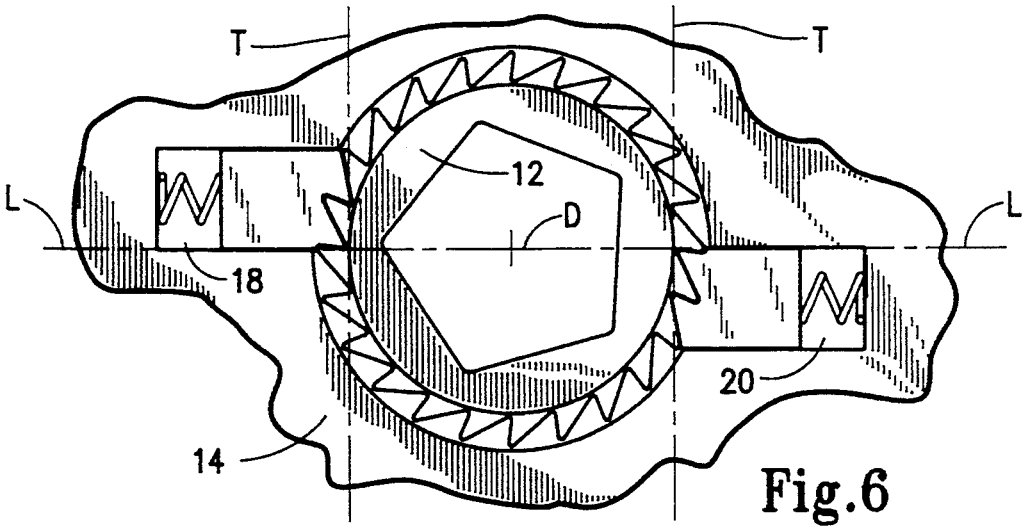
FIG. 6 is an exemplary arrangement of a pair of pawl elements registered with the driver teeth of the annular driver member.
Figure 7:
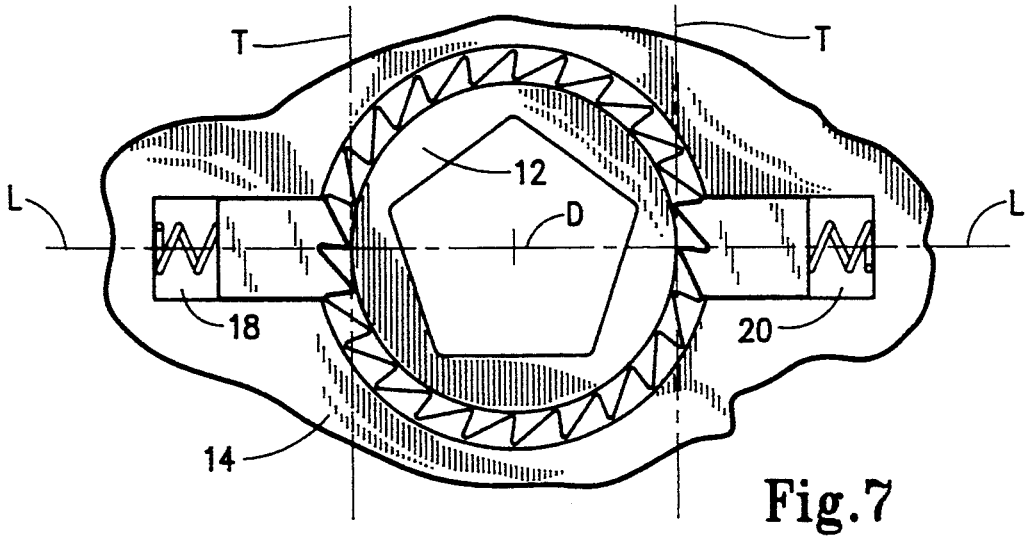
FIG. 7 is a second exemplary arrangement of a pair of pawl elements registered with the driver teeth of the annular driver member.

FIGS. 6 and 7 reflect how the pair of elongated recesses 16, 18 can be positioned within housing 14. In FIG. 6, the longitudinal axis "L" of the recesses 16, 18 are positioned with respect to an imaginary tangent line "T" which is tangent to a selected diameter "D" of the annular driver member 12 such that the longitudinal axes "L" are disposed substantially parallel to the selected diameter "D". In FIG. 7, the longitudinal axis "L" of the recesses 16, 18, are positioned with respect to the imaginary tangent line "T" to the selected diameter "D" of the annular driver member 12 such that the longitudinal axes "L" are disposed coextensively with the selected diameter "D".

To fully assemble ratchet wrench 10, reference is made again to FIGS. 1 and 2. The housing 14 receives the annular driver member 12 for rotational movement therein. As best shown in FIG. 2, a pair of pawl elements 22, 24 are dimensioned for slideable engagement between flat first and second sidewalls 46, 48 of each of the recesses 16, 18. Each pawl element 22, 24 is configured to sequentially register with the driver teeth 36 as the annular driver member 12 relatively rotates within the housing 14. The biased elements 26, 28 are received by the recesses 16, 18 to resiliently urge the respective pawl elements 22, 24 into contact with engaged ones of driver teeth 36 of the annular driver member 12. Then, the casing portion 44 receives the housing 14 having the annular driver member 12, the pawl elements 22, 24 and the bias elements 26, 28 operable therein. The first and second cover plates 30 and 32 are then fastened onto the handle 20 with the plurality of non-compressive bolt sets 34. Using non-compressive bolt sets 34 reduces simplified manufacturing and thus reduces costs. As best shown in FIG. 1, each of these non-compressive bolt sets 34 is received by a series corresponding bores 70 formed through cover plates 30, 32 and casing portion 44. One of ordinary skill would appreciate that other fasteners could be substituted for non-compressive bolt sets 34. For example, screws could be employed in lieu of the non-compressive bolt sets 34, but, in order to employ screws, each of the bores 70 must be tapped to provide mating threads for the screws.

One of ordinary skill in the art would also appreciate not only the relatively few number of components of ratchet wrench 10 but also would appreciate how easily ratchet wrench 10 can be assembled and dismantled for maintenance. The present invention affords an operator of the ratchet wrench 10 an opportunity to replace only a handle 20 if it becomes damaged. Alternatively, an operator of ratchet wrench 10 can replace a worn housing 14 or a broken bias element 26 or 28 without having to replace any other components.

Figure 8:
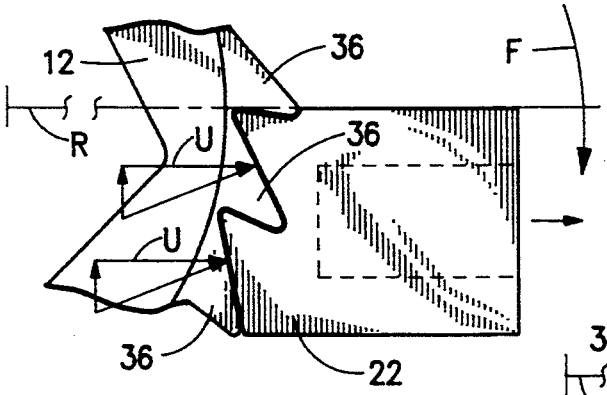
FIG. 8 is an enlarged partial view of the annular driver member exerting a radial force component against the pawl element to enable relative rotation between the annular driver member and the handle.

Once assembled, ratchet wrench 10 can be used for its intended purpose. The aperture 38 shown in FIG. 2 has been configured to detachably engage a workpiece such as the stem of a valve for a water main or a fire hydrant. With reference to FIGS. 2 and 8, when the annular driver member 12 is detachably engaged with the workpiece and the handle 20 moves angularly about the workpiece in a first direction "F", sequential ones of the driver teeth 36 are operative to exert a radial force component "U" against each of the pawl elements 22, 24 thereby displacing the pawl element 22, 24 longitudinally into the recesses 16, 18 respectively to enable relative rotation between the handle structure 16 and the annular driver member 12 as the sequential ones of the driver teeth 36 move pass the pawl elements 22, 24.

Figure 9:
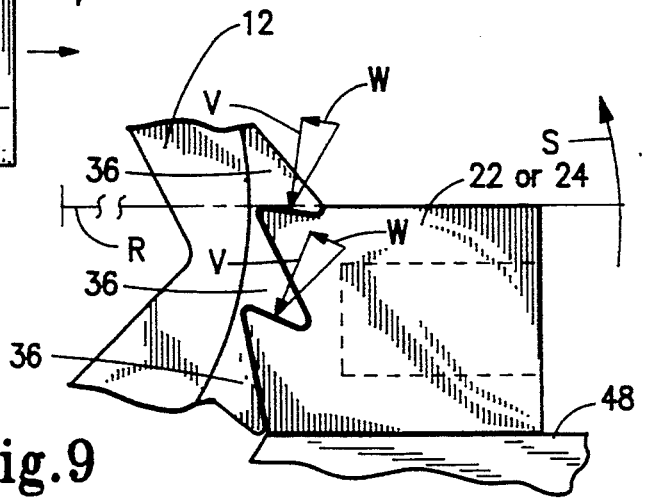
FIG. 9 is an enlarged partial view of the annular driver member exerting a compression force component against the pawl element to prohibit relative rotation between the annular driver member and the handle.

As shown in FIGS. 2 and 9, when the handle moves angularly about the workpiece in a second direction "S", opposite the first direction "F", engaged ones of the driver teeth 36 exert a compression force component "V", against the pawl elements 22, 24 and subsequently to the flat second sidewalls 48 of the recesses 16, 18 respectively in a direction perpendicular with respect to the selected diameter "D" of the annular driver member 12 thereby prohibiting relative rotation between the handle 20 and the annular driver member 12 so that rotational movement can be imparted to the workpiece. Furthermore, as shown in FIG. 9, when the handle structure 16 moves angularly about the workpiece in the second direction "S" opposite the first direction "F", the engaging ones of the driver teeth 36 exert a retention force component "W" against each of the pawl elements 22, 24 in a direction radially inwardly with respect to the annular driver member 12 thereby further urging the pawl elements 22, 24 into sequential registration with the annular driver member 12. This feature helps to assure that when movement is being imparted to a workpiece, slippage between the engaging ones of the driver teeth 36 and the pawl elements 22, 24 is minimized.

An operator can therefore either advance a workpiece by imparting motion to it usually in a clockwise direction or retract a workpiece by imparting motion to it usually in a counter-clockwise direction. With the present invention, the operator simply flip-flops the ratchet wrench to change from advancing the workpiece in a clockwise direction to retracting the workpiece in a counter-clockwise direction and vice versa.

Figure 10:
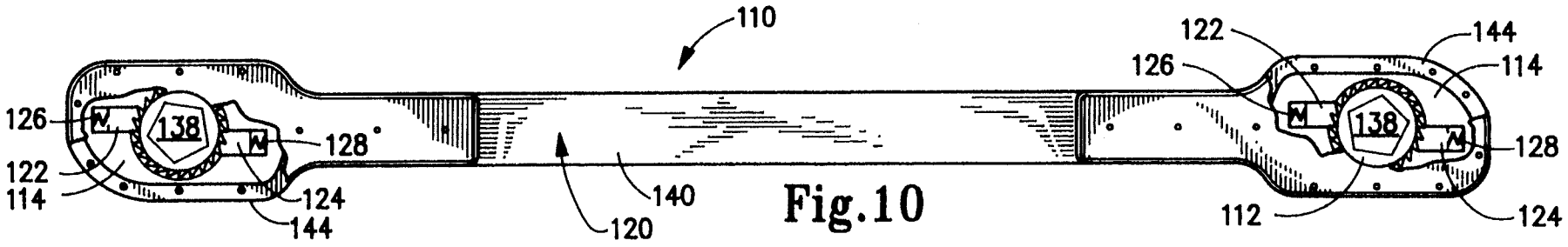
FIG. 10 is a top plan view, partially broken away, for a first alternative exemplary embodiment of the present invention.

A second exemplary embodiment of a ratchet wrench 110 of the present invention is shown in FIG. 10. This second exemplary embodiment of the present invention includes a handle 120 having a first handle portion 140 with two casing portions 144 located at opposite ends of the first handle portion 140. Each casing portion 144 receives a housing 114 as described above having a pair of pawl elements 122, 124, a pair of bias elements 126, 128 and an annular driver member 112 operable therein. The size of the apertures 138 extending through each annular driver member 112 are sized differently to facilitate the use of this second exemplary embodiment with fire hydrants. Typically, two differently sized apertures may be needed. One is required to open the valve and the other is required to open the ports.

Figure 11:
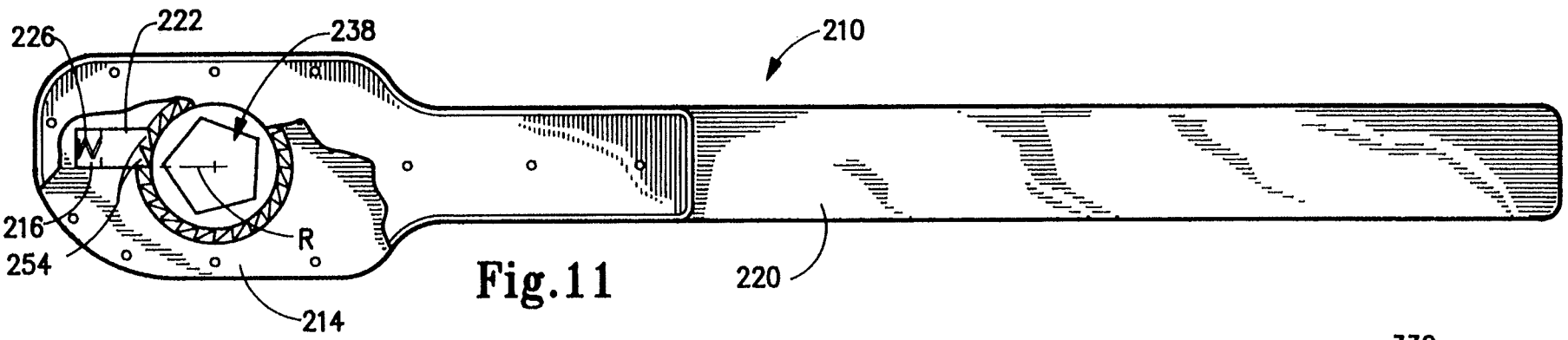
FIG. 11 is a top plan view, partially broken away, of a second alternative exemplary embodiment of the present invention.

FIG. 11 depicts a third exemplary embodiment of a ratchet wrench 210 of the present invention. The ratchet mechanism assembly of ratchet wrench 210 includes only one pawl element 222 and the housing 214 has only one recess 218. Note that the pawl element 222 includes two shoulder portions 254. It then follows that only one bias element 226 is needed to render the ratchet wrench 210 operable. Also, a handle 220 is integrated as a unit with the housing 214.

Figure 13:
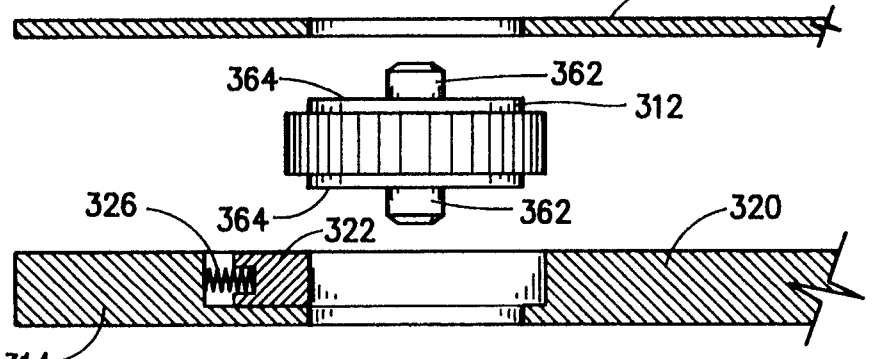
FIG. 13 is an exploded side elevational view in cross-section of the third alternative embodiment of the present invention shown in FIG. 12.
Figure 12:
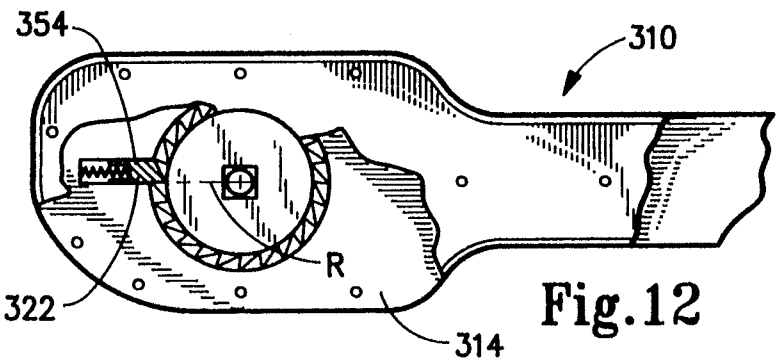
FIG. 12 is a top plan view, partially broken away, of a third alternative exemplary embodiment of the present invention.

A fourth exemplary embodiment of a ratchet wrench 310 of the present invention is shown in FIGS. 12 and 13. The ratchet wrench 310 is substantially identical with the ratchet wrench 210 shown in FIG. 11 with several modifications, however. One change is that the pawl element 322 has only one shoulder portion 354. Further, as best shown in FIG. 13, housing 314 is integrated with handle 320. Conventional techniques such as forging or molding can achieve this result of an integrated housing and handle. Thus, only one cover plate 330 is required to secure the annular driver member 312, pawl element 322 and the bias element 326 operably within the housing 314. Furthermore, as shown in FIGS. 13 and 14, the driver member 312 is solid and includes a pair of stubshafts 362 so that opening 238 is eliminated. Each of the stubshafts 362 is rigidly attached to respective outer surfaces 364 of the driver member 312. The stubshafts 362 project co-axially outwardly from the respective outer surfaces and are configured to operably receive a workpiece such as a conventional socket element which are commonly used.

As described, one of ordinary skill in the art would appreciate the advantages of the present invention. The present invention is sufficiently durable to withstand large torsional forces necessary to open and close large valves. The simple design of the present invention inherently includes performance reliability. The present invention could be used in emergency situations such as opening the valve of a fire hydrant.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A ratchet wrench adapted to impart rotational movement to a workpiece, comprising:

(a) an annular driver member including a plurality of driver teeth disposed circumferentially around an outer periphery thereof, said annular driver member being adapted to detachably engage the workpiece;

(b) a housing adapted to receive said annular driver member for rotational movement within said housing;

(c) a handle structure secured to and extending from said housing;

(d) an elongated recess having a longitudinal axis and extending into said housing, said recess being positioned with respect to an imaginary line tangent to a selected radius of said annular driver member such that said longitudinal axis is disposed substantially parallel to or coextensive with the selected radius;

(e) a pawl element slideably disposed within said recess and configured to sequentially register with said driver teeth as said annular driver member relatively rotates within said housing, said pawl element including a plurality of shoulder portions, each shoulder portion having a pawl working surface formed at an angle with respect to the longitudinal axis of said recess; and (f) a bias element resiliently urging said pawl element into contact with said annular driver member so that when said annular driver member is detachably engaged with the workpiece and said handle moves angularly about the workpiece in a first direction, sequential ones of said driver teeth are operative to exert a radial force component against said plurality of shoulder portions of said pawl element thereby displacing said pawl element longitudinally into said recess to enable relative rotation between said handle and said annular driver member as said sequential ones of said driver teeth move past said pawl element and, when said handle moves angularly about the workpiece in a second direction opposite said first direction, engaged ones of said driver teeth exert a compression force component against said plurality of shoulder portions of said pawl element perpendicularly with respect to the selected radius of said annular driver member thereby prohibiting relative rotation between said handle and said annular driver member so that rotational movement can be imparted to the workpiece and exert a retention force component against respective ones of said pawl working surfaces of said plurality of shoulder portions of said pawl element in a direction radially inwardly with respect to said annular driver member thereby further urging said pawl element into sequential registration with said annular driver member while rotational movement is imparted to the workpiece.

2. A ratchet wrench according to claim 1 wherein said recess includes a first side wall and a second side wall disposed opposite and parallel to first side wall.

3. A ratchet wrench according to claim 2 wherein one of said first and second side walls is coplanar with the selected radius of said annular driver member.

4. A ratchet wrench according to claim 1 wherein said pawl element includes a first contact surface and a second contact surface disposed at an acute angle with respect to said first contact surface to form a shoulder portion projecting radially inwardly and configured to matably engage said driver teeth of said annular driver member.

5. A ratchet wrench according to claim 1 wherein said annular driver member includes an aperture extending coaxially therethrough and configured to receive the workpiece.

6. A ratchet wrench according to claim 5 wherein said aperture is configured as a polygon.

7. A ratchet wrench according to claim 1 wherein said annular driver member includes a pair of stubshafts, each being rigidly attached to said annular driver member and projecting coaxially outwardly therefrom and on opposite sides thereof, said stubshafts configured to operably receive a second type of workpiece.

8. A ratchet wrench according to claim 1 further comprising a second handle rigidly attached to and extending from said housing in a direction opposite to said handle.

9. A ratchet wrench according to claim 1 wherein, when said handle moves angularly about the workpiece in said second direction opposite said first direction, said engaging ones of said driver teeth exert a retention force component against said pawl element radially inwardly of said annular driver member thereby further urging said pawl element into said sequential registration with said annular driver member.

10. A ratchet wrench adapted to impart rotational movement to a workpiece, comprising:

(a) an annular driver member including a plurality of driver teeth disposed circumferentially around an outer periphery thereof, said annular driver member being adapted to detachably engage the workpiece;

(b) a housing adapted to receive said annular driver member for rotational movement within said housing;

(c) a handle structure secured to and extending from said housing;

(d) an elongated recess having a longitudinal axis and extending into said housing, said recess being positioned with respect to an imaginary line tangent to a selected radius of said annular driver member such that said longitudinal axis is disposed coextensive with the selected radius, said recess having a flat first side wall coplanar with said radius of said annular driver member and a flat second side wall disposed parallel to said first side wall;

(e) a pawl element dimensioned for slideable engagement between said first and second side walls of said recess and configured to sequentially register with said driver teeth as said annular driver member relatively rotates within said housing, said pawl element including a plurality of shoulder portions, each shoulder portion having a pawl working surface formed at an angle with respect to the longitudinal axis of said recess; and (f) a bias element resiliently urging said pawl element into contact with said annular driver member so that when said annular driver member is detachably engaged with the workpiece and said handle moves angularly about the workpiece in a first direction, sequential ones of said driver teeth are operative to exert a radial force component against said plurality of shoulder portions of said pawl element thereby displacing said pawl element longitudinally into said recess to enable relative rotation between said handle and said annular driver member as said sequential ones of said driver teeth move past said pawl element and when said handle moves angularly about the workpiece in a second direction opposite said first direction, engaged ones of said driver teeth exert a compression force component against said plurality of shoulder portions of said pawl element and subsequently to said second side wall of said recess perpendicularly with respect to the selected radius of said annular driver member thereby prohibiting relative rotation between said handle and said annular driver member so that rotational movement can be imparted to the workpiece and exert a retention force component against respective ones of said pawl working surfaces said plurality of shoulder portions of said pawl element in a direction radially inwardly with respect to said annular driver member thereby further urging said pawl element into sequential registration with said annular driver member while rotational movement is imparted to the workpiece.

11. A ratchet wrench according to claim 10 wherein said pawl element includes a first contact surface and a second contact surface disposed at an acute angle with respect to said first contact surface to form a shoulder portion projecting radially inwardly and configured to matably engage said driver teeth of said annular driver member.

12. A ratchet wrench according to claim 10 wherein said annular driver member includes an aperture extending coaxially therethrough and configured to receive the workpiece.

13. A ratchet wrench according to claim 12 wherein said aperture is configured as a polygon.

14. A ratchet wrench according to claim 10 wherein said annular driver member includes a pair of stubshafts, each being rigidly attached to said annular driver member and projecting coaxially outwardly therefrom and on opposite sides thereof, said stubshafts configured to operably receive a workpiece.

15. A ratchet wrench according to claim 10 further comprising a second handle rigidly attached to and extending from said housing in a direction opposite to said handle.

16. A ratchet wrench according to claim 10 wherein, when said handle moves angularly about the workpiece in said second direction opposite said first direction, said engaging ones of said driver teeth exert a retention force component against said pawl element radially inwardly of said annular driver member thereby further urging said pawl element into said sequential registration with said annular driver member.

17. A ratchet wrench adapted to impart rotational movement to a workpiece, comprising:

(a) an annular driver member including a plurality of driver teeth disposed circumferentially around an outer periphery thereof, said annular driver member being adapted to detachably engage the workpiece;

(b) a housing adapted to receive said annular driver member for rotational movement within said housing;

(c) a handle structure secured to and extending from said housing;

(d) a pair of elongated recesses, each having a longitudinal axis, extending into said housing and being positioned relative to a respective imaginary line tangent to a selected diameter of said annular driver member such that said longitudinal axis of each said recess is disposed substantially parallel to or coextensive with the selected diameter, each of said recesses having a flat first side wall coplanar with the selected diameter of said annular driver member and a flat second side wall disposed parallel to said first side wall, said first side walls of said pair of recesses being coplanar with each other;

(e) a pair of pawl elements, each of said pawl elements dimensioned for slideable engagement between said first and second side walls of said recess and configured to sequentially register with said driver teeth as said annular driver member relatively rotates within said housing, each of said pawl elements including a plurality of shoulder portions, each of said shoulder portions having a pawl working surface formed at an angle with respect to the longitudinal axis of respective ones of said recesses; and (f) a pair of bias elements, each of said bias elements resiliently urging each of said pawl elements into contact with said annular driver member so that when said annular driver member is detachably engaged with the workpiece and said handle moves angularly about the workpiece in a first direction, sequential ones of said driver teeth are operative to exert a radial force component against said plurality of shoulder portions of each of said pawl elements thereby displacing said pawl elements longitudinally into said recesses to enable relative rotation between said handle and said annular driver member as said sequential ones of said driver teeth move past said pawl elements and, when said handle moves angularly about the workpiece in a second direction opposite said first direction, engaged ones of said driver teeth exert a compression force component against said plurality of shoulder portions of each of said pawl elements and subsequently to said second side walls of said recesses in a direction perpendicular with respect to the selected diameter of said annular driver member thereby prohibiting relative rotation between said handle and said annular driver member so that rotational movement can be imparted to the workpiece and exert a retention force component against respective ones of said pawl working surfaces of said plurality of shoulder portions of each of said pawl elements in a direction radially inwardly with respect to said annular driver member thereby further urging said pawl element into sequential registration with said annular driver member while rotational movement is imparted to the workpiece.

18. A ratchet wrench according to claim 17 wherein each of said pawl elements includes a first contact surface and a second contact surface disposed at an acute angle with respect to said first contact surface to form a shoulder portion projecting radially inwardly and configured to mateably engage said driver teeth of said annular driver member.

* * * * *